US005944065A

United States Patent [19]

Tanoory et al.

[11] Patent Number: 5,944,065

[45] Date of Patent: Aug. 31, 1999

[54] WIRE COLLECTION APPARATUS

[76] Inventors: Robert J. Tanoory, 1 Hampden Pl., Utica, N.Y. 13502; Edward H. Majka, 2288 Graffenburg Rd., Sauquoit, N.Y. 13456

[21] Appl. No.: 08/990,179

[22] Filed: Dec. 12, 1997

[51] Int. Cl.[6] ..... B21F 11/00

[52] U.S. Cl. ..... 140/140; 83/157; 414/745.1

[58] Field of Search ..... 140/140; 83/157, 83/159; 72/203, 250, 426; 198/431, 418.6, 448, 451, 468.8; 414/745.1, 745.7, 746.3

[56] References Cited

U.S. PATENT DOCUMENTS

| | | | |
|---|---|---|---|
| 1,489,984 | 4/1924 | Datisman et al. | 140/140 |
| 1,505,991 | 9/1924 | Wiseman | 140/140 |
| 1,640,957 | 8/1927 | McMillen | 72/250 |
| 1,732,224 | 10/1929 | Danziger | 140/140 |
| 3,062,390 | 11/1962 | Schwalm et al. | 198/431 |
| 3,916,662 | 11/1975 | Arnold | 72/426 |
| 4,158,976 | 6/1979 | Ditges | 83/157 |
| 4,266,455 | 5/1981 | Ago | 83/84 |
| 4,448,298 | 5/1984 | Matsuo | 198/451 |
| 4,493,233 | 1/1985 | Dusel et al. | 83/71 |
| 4,502,586 | 3/1985 | Dusel et al. | 198/345 |

OTHER PUBLICATIONS

Wire Systems Product Information Flyer, Model WC1000.

*Primary Examiner*—Lowell A. Larson
*Attorney, Agent, or Firm*—Trapani & Molldrem

[57] ABSTRACT

A wire collection apparatus for use with a wire cutting machine. The apparatus comprises a tubular wire channel, a rotating tubular channel closure, and an actuator device. The wire channel contains an axial opening along the entire length of the channel. The channel contains a proximal opened end for receiving a portion of wire from the cutting machine and a distal opened end for allowing the leading terminus of the wire portion to extend therethrough, if necessary. The channel closure is positioned inside of and is substantially concentric with the wire channel. The closure contains an axial opening along the entire length of the closure and contains opened ends in alignment with the proximal and distal ends, respectively, of the wire channel. The closure is rotatable inside the channel between opened and closed positions to open and close the axial opening of the channel, respectively. The axial openings of the closure and the channel are in alignment in the opened position and out of alignment in the closed position. The actuating device is coupled to the closure and configured to rotate the closure between the opened and the closed positions.

8 Claims, 4 Drawing Sheets

WIRE COLLECTION APPARATUS

BACKGROUND OF THE INVENTION

1. Technical Field

The present invention relates generally to apparatus for cutting segments of wire or cable from a supply of such wire or cable, and, more particularly to apparatus which collect the wire or cable segments discharged from such wire and cable cutting apparatus.

2. Background Art

With the advent of automated machinery, wire and cable cutting machines were developed and successfully employed to produce a wide variety of wire and cable products. Such machines operate on a supply of wire or cable (e.g., a reel or continuous feed strand) and cut relatively short segments from this supply for further processing and assembly. An obvious problem presented by such automated machines is how to handle or collect the segments as they are discharged from such machines. Some of these machines can operate at relatively high rates of speed (i.e., high cycle rates), producing 20–30 segments of wire or cable per minute. The problem of handing such demanding outputs has been long-standing, and, heretofore, has not been adequately addressed in the art.

Conventional approaches to collection or handling of wire segments from cutting machines have included—collection hangers, trays, troughs or tubes; conveyer belt systems; and coiling pans or baskets. For example, U.S. Pat. No. 4,502,586 to Dusel et al. discloses a conveyer belt for conveying wire segments, and U.S. Pat. No. 4,266,455 to Ago discloses a conveyer belt and collection tray arrangement.

The disadvantage with simply using collection trays, troughs, etc., is that the wire segments (especially if longer than 2–3 feet) usually become entangled in these collectors. Such entanglements preclude further processing of these segments until they are untangled—usually by a manual operator. This severely slows the manufacturing process of wire or cable products. The entanglement problem is especially acute when such collectors are intended to retrieve a large number of segments (e.g., 1,000 pieces). Thus, such collector devices are limited to small output applications and short segment lengths.

Conveyer belt systems are usually employed when it is desired to fully automate the processing of the segments from supply strand to finished product (e.g., electrical extension cord). After the segments are cut, they are conveyed by conveyer belt to the next station for further processing. One disadvantage of conveyer belt systems is that they are usually designed for a particular application, involving a narrow range of segment lengths and discharge rates. They are generally not flexible enough to handle a wide range of segment lengths and discharge rates. In addition, such systems require relatively low discharge rates for proper handling of the segments. Moreover, such systems are expensive and require a relatively high degree of maintenance.

Coiling pans are only suitable for coiled pieces. They can only collect one piece at-a-time, usually requiring manual removal of each piece on each cutting cycle of the cutting machine. Such manual intervention severely limits the rate at which the machine can be set to discharge the segments. Moreover, such devices are only suitable for segment lengths in the narrow range of 2–6 feet.

Attempts have been made to devise a collection channel in which a wire or cable portion is inserted either after or before being cut by the cutting machine. The collection channel acts to stabilize the wire or cable portion before it is directed to (e.g., dropped into) a collector, such as a tray, trough, etc. By stabilizing the wire or cable portion first, the portion (after being cut) can be neatly arranged in the collector, and entanglements can be minimized. An example of such a collection channel is shown in U.S. Pat. No. 4,158,976 to Ditges.

In Ditges, a wire segment is feed into a wire channel 23 (FIG. 5) and then cut from the main strand in the cutting machine. The segment is then dropped out of the channel when a closure 34 is opened (FIG. 5). The segment is then collected by an array of bracket-like collectors 45 (FIG. 8). While achieving the advantages of stabilizing the wire segment before collection, the Ditges design is limited because of its closed channel (i.e., the distal end is closed—See FIGS. 1 and 2). In fact, stops 17 are inserted into the channel to stop the wire segment (See FIG. 2).

Obvious drawbacks of this design include—(1) the closed end or stop can blunt or deform the terminus of the wire segment, which is very undesirable for many applications; and (2) the channel imposes a limit on the segment length that can be collected therein. To overcome the latter drawback, Ditges suggests that the channel be made modular, so that the channel can be extended by adding on modules 20 (FIG. 3). This approach adds to the expense of the wire channel. Moreover, channel reconfiguration (to adjust channel length) requires operator intervention, is time consuming, and inconvenient.

Another example of a wire channel at the output of a wire cutting machine is shown in U.S. Pat. No. 4,493,233 to Dusel et al. (FIGS. 10–16). In Dusel et al., a wire channel 190 receives a wire portion through a proximal opened end and allows the terminus of the wire portion to extend through a distal opened end (FIG. 10). The wire portion is metered into the channel, and the channel is opened prior to the cutting operation (FIG. 11). Unlike Ditges, the wire portion in Dusel et al. is stabilized outside the channel just before cutting and collection by a conveyer belt (FIG. 12). This approach limits the speed at which wire segments can be collected in an orderly fashion.

In a further example, the inventors named herein developed a wire collection apparatus (referred to as the WC1000™) having a tubular wire collection channel and a closure for opening and closing the wire collection channel. The closure was also a tubular channel and was positioned inside of and in concentric relation to the wire collection channel. Both the collection channel and closure contained elongated axial openings (or slots) The closure was rotatable inside the collection channel. When the axial openings of the channel and closure were in alignment, the channel was opened. When they were out of alignment, the channel was closed except for about six inches near the distal end of the collection channel. The axial slot of the closure is widened near the distal end of the collection channel, so that it does not fully close the axial slot of the collection channel at this location. The result is an elongated pening through the collection channel, about six inches long, which allows the terminal end of a wire segment to be discharged before the closure opens the channel. A deflector, located inside the closure, deflects the terminus end of the wire segment down through the elongated opening. The closure was actuated by a pneumatic actuator located at the distal end of the channel. The actuator blocked the distal end of the collection channel, preventing wire portions from extending through the distal end of the channel.

The WC1000 design required two width dimensions in the axial slot of the closure and required a deflector. Both features added to the complexity and manufacturing cost of the machine. In addition, the actuator rotated the closure tube from one end, creating an undesirable torque on the tube. This torque created imbalances which resulted in uneven wear and increased operating noise.

OBJECTS AND SUMMARY OF THE INVENTION

It is therefore an object of the present invention to overcome the problems associated with the prior art, as discussed above, and to provide an improved wire collection apparatus.

It is another object of the present invention to provide a wire collection apparatus that collects and neatly arranges wire segments discharged from a wire cutting machine.

It is a further object of the present invention to provide a wire collection apparatus that collects and arranges a relatively large number of wire segments without entanglement.

It is yet another object of the present invention to provide a wire collection apparatus that collects and arranges wire segments at relatively high discharge rates.

It is yet a further object of the present invention to provide a wire collection apparatus that collects and arranges wire segments having a wide range of segment lengths.

It is still another object of the present invention to provide a wire collection apparatus that collects and arranges segments which are longer than the collection channel of the apparatus.

It is still a further object of the present invention to provide a wire collection apparatus that collects and arranges wire segments having a wide range of thicknesses.

It is yet still another object of the present invention to provide a wire collection apparatus that collects and arranges wire segments of a wide variety of wire types.

It is yet still a further object of the present invention to provide a wire collection apparatus that does not blunt or otherwise deform the wire segments upon collection.

It is yet still another object of the present invention to provide a wire collection apparatus that can reduce the number of operators handling the wire segments collected and arranged by the apparatus.

It is yet still a further object of the present invention to provide a wire collection apparatus that is relatively simple in design, resulting in low cost, ease of operation, and low maintenance.

These and other objects are attained in accordance with the present invention wherein there is provided a wire collection apparatus for use with a wire cutting machine. The apparatus comprises a tubular wire channel, a tubular channel closure, and an actuator device. The tubular wire channel contains an axial opening along the entire length of the channel. The wire channel contains a proximal opened end for receiving a portion of wire from the wire cutting machine and a distal opened end for allowing the leading terminus of the wire portion to extend therethrough, if necessary.

The tubular channel closure is positioned inside of and is substantially concentric with the tubular wire channel. The closure contains an axial opening along the entire length of the closure and contains opened ends in alignment with the proximal and distal ends, respectively, of the wire channel. The closure is rotatable inside the channel between opened and closed positions to open and close the axial opening of the channel, respectively. The axial openings of the closure and the channel are in alignment in the opened position and out of alignment in the closed position.

The actuating device is coupled to the closure and configured to rotate the closure between the opened and the closed positions.

In the preferred operation, the axial opening of the wire channel is closed when a portion of wire is received in the channel and opened to discharge the wire portion after being cut by the wire cutting machine. The wire portion may be cut either before or after it is received into the wire channel.

The tubular wire channel may further contain an opening extending transversely along an arc of the channel and located substantially at the midpoint between the proximal and distal ends of the channel. The actuating device is mounted to the closure through the transverse opening of the channel. The transverse opening has a dimension along the arc of the channel which is sufficient to allow the actuating device to rotate the closure between the opened and closed positions.

BRIEF DESCRIPTION OF THE DRAWING

Further objects of the present invention will become apparent from the following description of the preferred embodiments with reference to the accompanying drawing, in which.

DESCRIPTION OF THE PREFERRED EMBODIMENT

Figure 1:
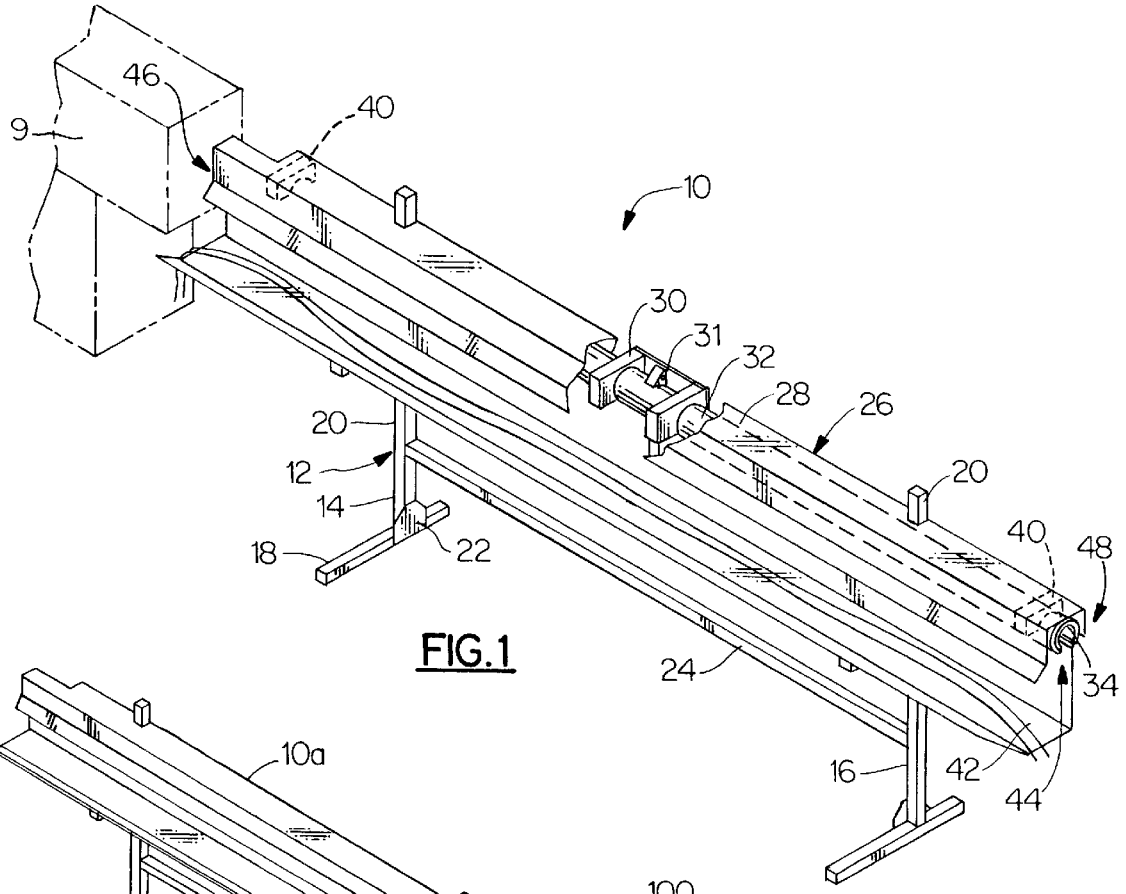
FIG. 1 is a perspective view of a wire collection apparatus of the present invention, stationed adjacent to a wire cutting machine.

Referring now to FIG. 1, there is shown a wire collection apparatus 10 constructed in accordance with the present invention. Apparatus 10 is stationed adjacent to the discharge end of a wire cutting machine 9, and aligned with a discharge port or a pair of nip rollers (not shown) of machine 9. Apparatus 10 is configured to receive a portion of wire or cable fed or discharged from machine 9 through the discharge port or nip rollers. The term "wire" as used in this specification, including the claims, herein, shall mean both wire and cable.

Again referring to FIG. 1, wire collection apparatus 10 includes a support 12 which is in the form of an upright stand. Stand 12 is self-supporting, and functions to support collection apparatus 10 in a fixed position without additional supports, braces or brackets. Stand 12 includes two vertical upright assemblies 14 and 16. Each upright assembly includes a base 18, a vertical leg 20, and a "T" joining plate 22. Upright assemblies 14 and 16 are joined together by a horizontal bar 24 to complete the stand assembly. Support 12 does not have to be configured as a self-supporting stand. For example, support 12 may be a bracket or system of brackets, a hanger or system of hangers which suspend apparatus 10, or the wire cutting machine itself.

Figure 2:
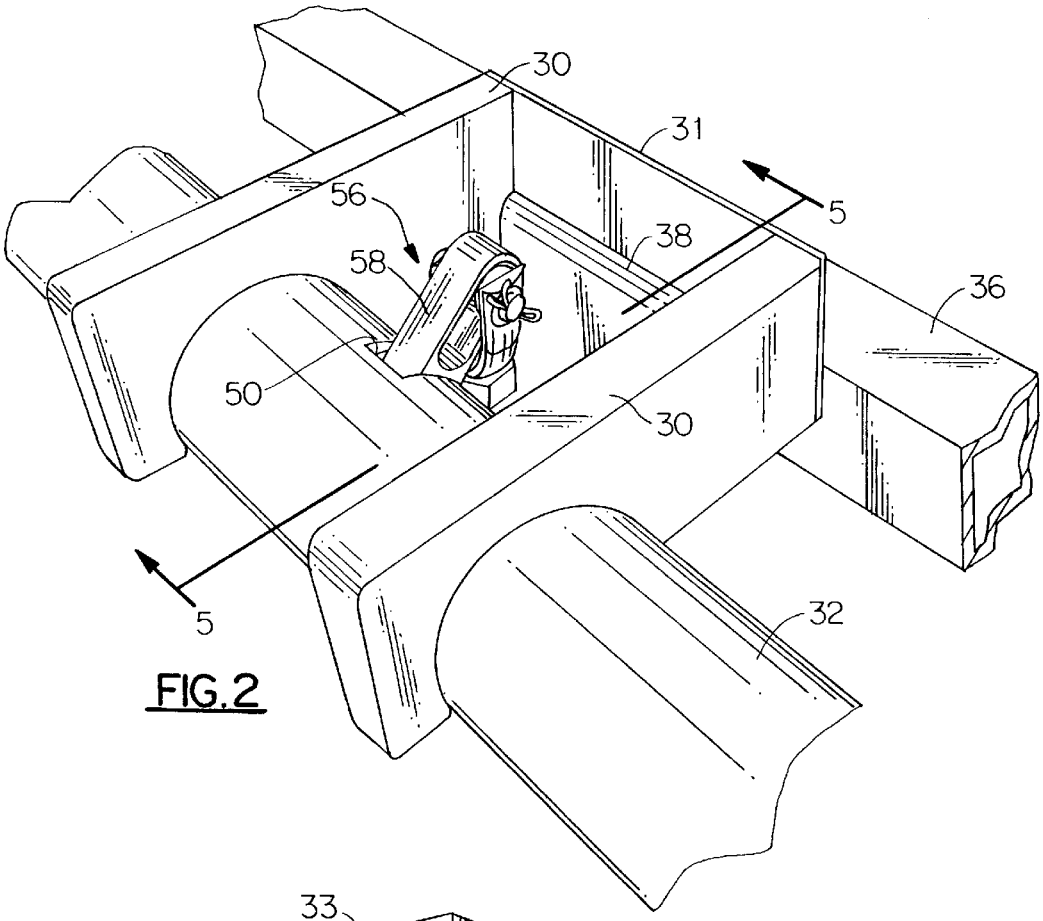
FIG. 2 is a top perspective, fragmented view of the midsection of the wire collection apparatus of FIG. 1.
Figure 3:
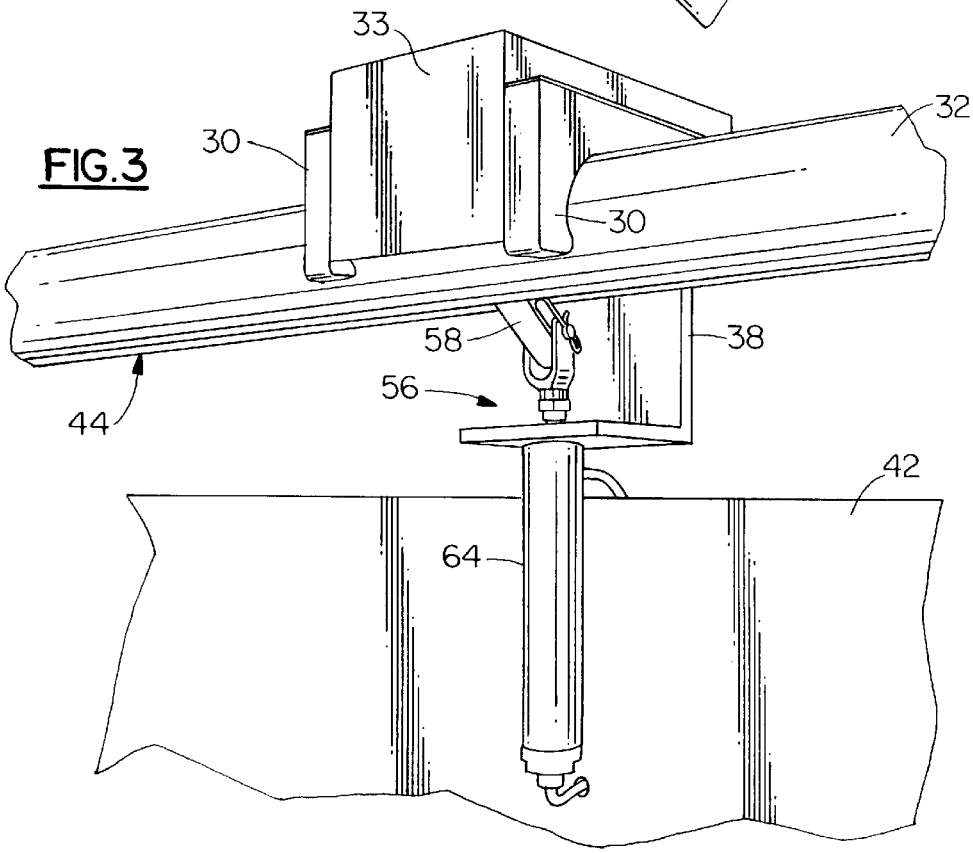
FIG. 3 is a bottom perspective, fragmented view of the midsection of the wire collection apparatus of FIG. 1.
Figure 4:
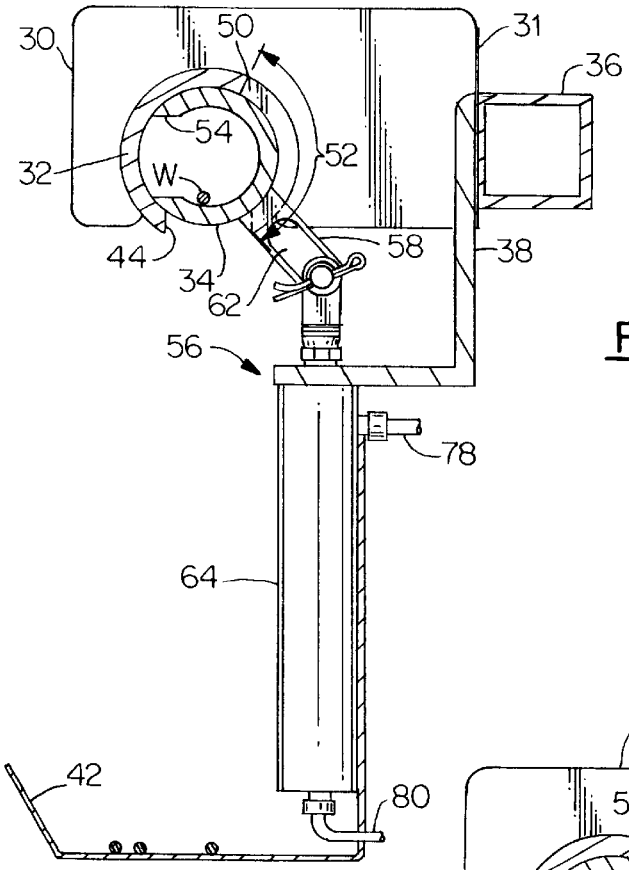
FIG. 4 is a cross-sectional view of the wire collection apparatus, taken along line 5—5 in FIG. 2, showing the wire channel in a closed position.
Figure 5:
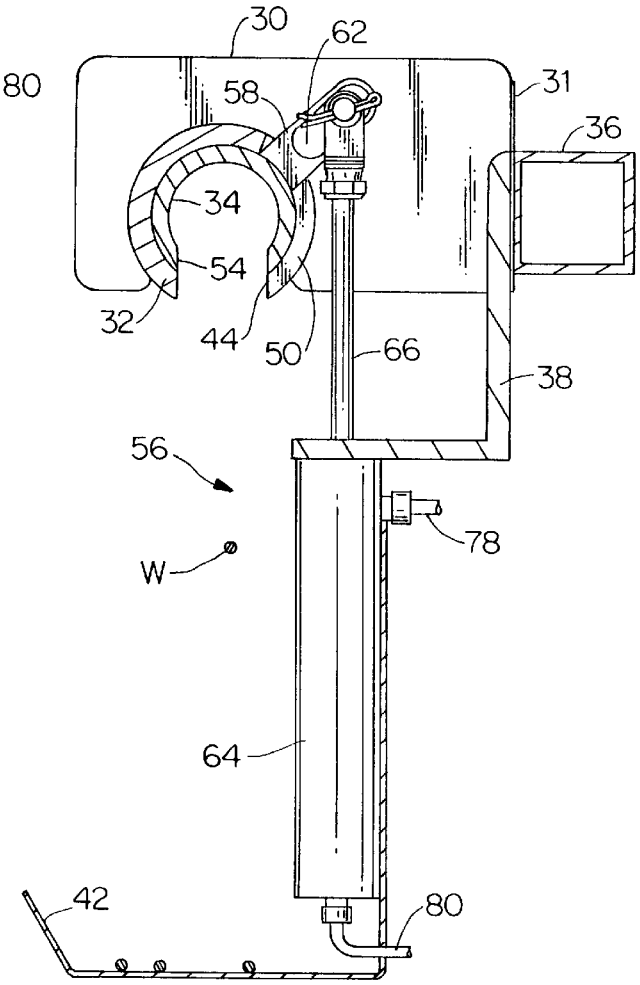
FIG. 5 is a cross-sectional view of the wire collection apparatus, taken along line 5—5 in FIG. 2, showing the wire channel in an opened position.

As shown in FIG. 1, wire collection apparatus 10 further includes a main collection assembly 26 which is adjustably mounted to stand 12. Assembly 26 includes a stainless steel guard or cover 28, a pair of inboard tube hangers 30, a clevis guard box 33 (FIG. 3), a tubular wire channel 32, a tubular channel closure 34 (FIG. 4), a main support bar 36 (FIGS. 2 and 4), a clevis guard plate 38 (FIGS. 2–4), and a pair of outboard tube hangers 40 (FIG. 1). A mounting plate 31 is provided for mounting inboard hangers 30 to support bar 36. As best shown in FIGS. 2, 4 and 5, clevis guard plate 38 is also mounted to support bar 36, via mounting plate 31. A pair of bolts (not shown) are passed through clevis plate 38 and mounting plate 31, and then threaded into support bar 36, to effect the mountings. Outboard tube hangers 40 are directly mounted to support bar 36 by threaded screws.

Assembly 26 is mounted to stand 12 by use of locking nuts on support bar 36, which engage slotted holes in vertical legs 20. That is, support bar 36 is mounted to legs 20 by use of locking nuts. The height of assembly 26 can be adjusted on stand 12 by loosening the locking nuts on support bar 36. Once the nuts are loose, support bar 36 can be raised or lowered. The locking nuts slide up or down in the slotted holes in legs 20. Once the desired height is reached, the locking nuts are tightened again to fix assembly 26 on stand 12.

Tubular wire channel 32 is fixedly mounted to tube hangers 30 and 40 by use of screws (not shown), which are threaded through the channel from the inside and into the hangers to fix the channel to the hangers. As shown in FIG. 3, clevis guard box 33 is mounted to inboard tube hangers 30 with screws (not shown). Cover 28 covers the main assembly components (See FIG. 1), and is mounted with bolts (not shown) to L-shaped brackets (not shown) on support bar 36. Cover 28 may be further secured by screws threaded into outboard tube hangers 40.

As shown in FIGS. 1, 4 and 5, wire collection apparatus 10 further comprises a stainless steel wire collector or tray 42. Tray 42 is aligned with tubular wire channel 32 to collect wire segments dropping from the channel, as will be describe further hereinbelow. Tray 42 is mounted to vertical support legs 20 by way of locking screws and mounting brackets (not shown). The top of tray 42 should not be less than one-quarter inch (¼") from the bottom of channel 32.

In the preferred embodiment, tubular wire channel 32 is a cylindrical tube made of, e.g., 2 inch diameter PVC schedule 80 material. A typical length for channel 32 is 10 feet. Channel 32 contains an axial opening 44 which runs along the entire length of the channel (FIGS. 1, 4 and 5). The width of axial opening 44 may be, e.g., slightly greater than one inch. Channel 32 contains a proximal opened end 46 (FIG. 1) for receiving a portion of wire from wire cutting machine 9. Channel 32 also contains a distal opened end 48 (FIG. 1) for allowing the leading terminus of the wire portion to extend therethrough, if necessary. The opened distal end 48 allows apparatus 10 to collect and arrange wire segments which are longer than channel 32. For example, if channel 32 is ten (10) feet long, wire segments over 16 feet long can be collected and neatly arranged in tray 42.

As shown in FIGS. 2, 4 and 5, channel 32 contains another opening (or slot) 50 which extends transversely along an arc 52 (FIG. 4). In the preferred embodiment, transverse opening 50 is a slot which communicates with axial opening 44 (FIGS. 4 and 5). In addition, opening 50 is located substantially at the midpoint of channel 32, between proximal and distal ends 46 and 48.

Referring now to FIGS. 4 and 5, tubular closure 34 is shown positioned inside of and substantially concentric with channel 32. Tubular closure 34 is approximately the same length or slightly longer (e.g., ½ inch) than channel 32. In the preferred embodiment, closure 34 is a cylindrical tube made of, e.g., 1.5 inch diameter CPVC schedule 80. Closure 34 contains an axial opening 54 which extends along the entire length of the closure. Axial opening 54 may be, e.g., about one inch wide. Closure 34 further contains proximal and distal opened ends (FIG. 1) which are in alignment with proximal and distal ends 46 and 48, respectively, of channel 32. Closure 34 is rotatable inside channel 32 between a closed position (FIG. 4) and an opened position (FIG. 5). In the closed position, closure 34 closes axial opening 44 of channel 32 (FIG. 4). In the opened position, closure 34 opens axial opening 44 of channel 32 (FIG. 5). The axial openings of closure 34 and channel 32 are in alignment when closure 34 is in the opened position (FIG. 5) and out of alignment when closure 34 is in the closed position (FIG. 4).

As best shown in FIGS. 2–5, wire collection apparatus 10 further includes an actuating device 56 which is coupled to tubular closure 34. Actuating device 56 is configured to rotate closure 34 between the opened and the closed positions (FIGS. 4 and 5). In the preferred embodiment, actuating device 56 is mounted to tubular closure 34 through transverse slot 50 of channel 32 (FIGS. 4 and 5). This arrangement locates the actuator at the midpoint of closure 34, ensuring power delivery to a balanced load. Slot 50 has a dimension along arc 52 which is sufficient to allow actuating device 56 to rotate closure 34 between the opened and closed positions (FIGS. 4 and 5).

Figure 7:
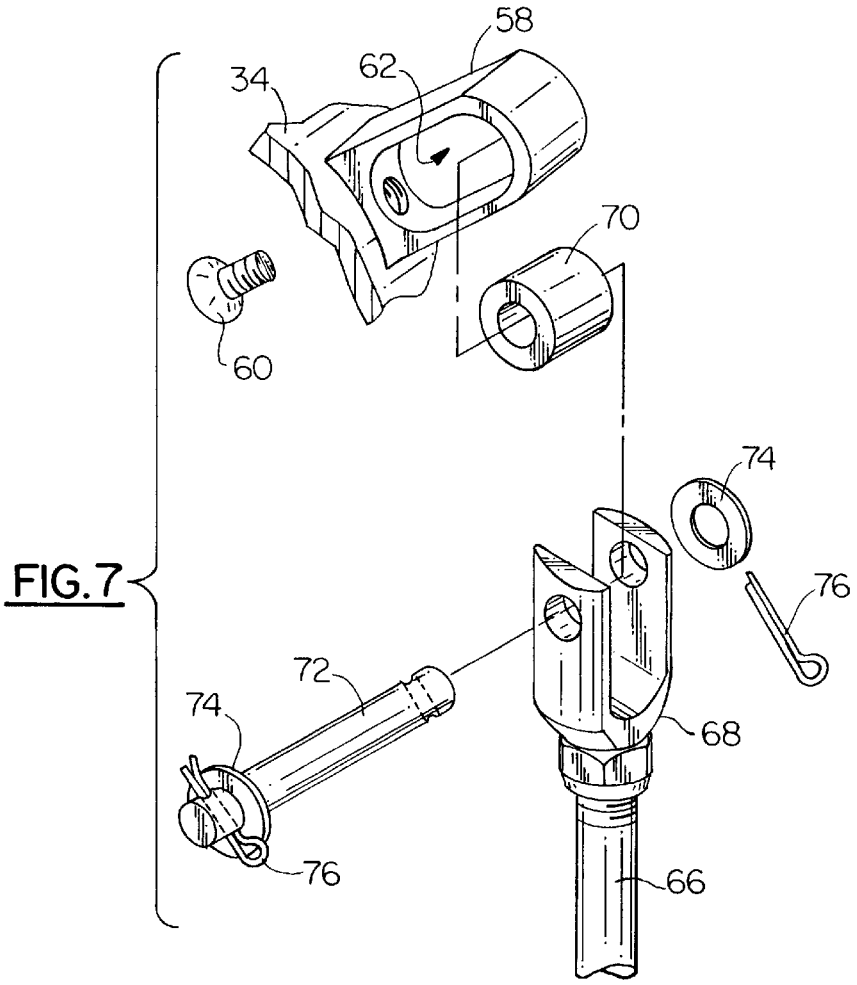
FIG. 7 is an exploded view of the coupling between the actuating device and the channel closure of the wire collection apparatus.

Referring now to FIG. 7, actuating device 56 includes a stem 58 having one end mounted to tubular closure 34 by means of a screw 60, threaded through the closure from the inside. The bore in closure 34, through which screw 60 is threaded, is countersunk so the head of screw 60 is flush with or below the interior surface of the closure. This ensures that screw 60 will not obstruct the wire portions as they are received in the closure. As best shown in FIGS. 4 and 5, stem 58 projects radially from closure 34 and out through slot 50 of channel 32. Stem 58 contains an elongated hole 62 which extends along the length of the stem (See FIG. 7).

As shown in FIGS. 3–5, actuating device 56 further includes a pneumatic cylinder 64 which is mounted to clevis plate 38. Cylinder 64 has a reciprocating piston arm 66 (FIG. 5) which is pivotally and slidably coupled to stem 58. This coupling is best understood from the exploded view shown in FIG. 7. A clevis 68 is attached to the distal end of piston arm 66, and is dimensioned to receive stem 58 therein. A cylindrical bearing 70 is received in elongated hole 62 of stem 58, and slidably engages the stem. Stem 58 and bearing 70 are both, in turn, received in clevis 68. A clevis pin 72 extends through clevis 68, bearing 70, and elongated hole 62, such that a pivotal and slidable coupling is effected between piston arm 66 and stem 58. Clevis pin 72 is held in place by a washer 74 and a cotter pin 76 on each side of clevis pin 72. As shown in FIG. 3, clevis guard box 33 protects the clevis linkage from the top of apparatus 10. Clevis plate 38 may include side walls (not shown) to protect the linkage from the sides.

Cylinder 64 is a double-acting air cylinder which causes piston arm 66 to move in a reciprocating manner. The reciprocating motion of arm 66 is translated into a smooth, positive and negative rotational motion of closure 34. Cylinder 64 may be a BIMBA 093D double-acting air cylinder having a maximum stroke of 3 inches.

Figure 8:
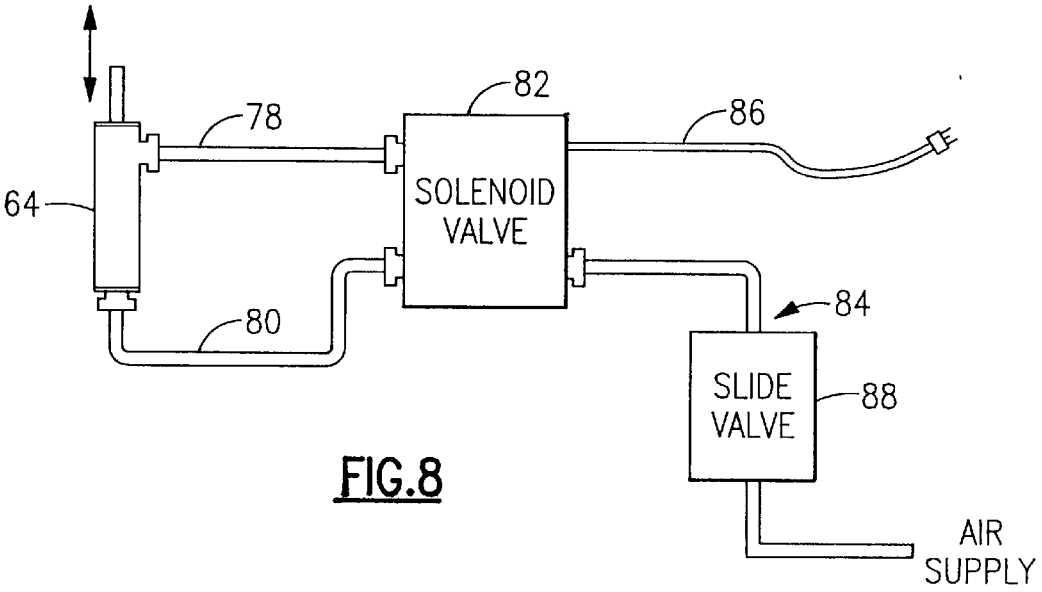
FIG. 8 is a schematic diagram of the pneumatic drive system for the actuating device of the wire collection apparatus.

As shown in the schematic diagram of FIG. 8, cylinder 64 is driven by two air lines 78 and 80, in the usual manner. Air lines 78, 80 are connected to the output ports of a solenoid valve 82. Valve 82 is mounted on the rear of support bar 36. An air line 84 is connected to the input port of valve 82, to provide an air supply to the valve. Valve 82 is controlled by electrical pulses received through electrical cable 86. Valve 82 is operative to toggle (or switch) the air supply between output air lines 78, 80 in response to each pulse received via cable 86. A slide valve 88 may also be included, in-line, in air line 84. Slide valve 88 allows one to manually open and close line 84, to pressurize and de-pressurize the drive system.

The overall operation of wire collection apparatus 10 will now be described. Initially, apparatus 10 is placed as close as possible to the discharge port or exit of wire cutting machine 9. Then supply line 84 is connected to an air supply, such as an air compressor, with slide valve 88 in the closed position. Electrical cable 86 is connected to an auxiliary output on cutting machine 9. This output produces a 24 volt pulse upon completion of each cycle of operation (e.g., each cutting cycle) of machine 9. Slide valve 88 is then opened to pressurize the drive system to actuating device 56 (FIG. 8). Wire collection apparatus 10 is now ready to run in synchronism with the operation of wire cutting machine 9.

This synchronous operation is best understood from FIGS. 4 and 5.

As shown in FIG. 4, axial opening 44 of wire channel 32 is closed by closure 34 when a portion of wire W is received into the channel. In a typical mode of operation, most of wire portion W is received into channel 32 before it is cut. Upon completion of an operating cycle of machine 9 (i.e., after the cutting and discharge of wire portion W from machine 9), a 24 volt trigger pulse is generated on its auxiliary output. This pulse is received, via cable 86, by solenoid valve 82 which causes the air supply to switch from air line 78 to air line 80. This switch in air lines causes air cylinder 64 to push piston arm 66 upward, thus rotating closure 34 to the opened position, as shown in FIG. 5. In the opened position, the cut wire portion (or segment) W is allowed to drop into tray 42 (FIG. 5). Once the 24 volt pulse passes, solenoid valve 82 responds by switching the air supply back to line 78. This causes cylinder 64 to push piston arm 66 down, thus rotating closure 34 back to the closed position (FIG. 4). It is thus understood that actuating device 56 rotates closure 34 between opened and closed positions, in synchronism with each operating cycle of cutting machine 9.

It is to be understood that actuating device 56 does not have to be an air cylinder system, as described above. For example, it could be a hydraulic or electrical (motor) system. In addition, in the air cylinder system described above, other electrical inputs (e.g., 120 volt pulse) may be employed to drive the solenoid valve, depending on the outputs available from the wire cutting or stripping machine. Further, some machines provide an air supply, which can allow for direct drive of cylinder 64 (eliminating the need for a solenoid valve and electrical input). All such arrangements are contemplated by the present invention, as claimed herein.

Wire collection apparatus 10 is capable of collecting and arranging wire segments over a wide range of lengths, e.g., 1–16 feet. In addition, apparatus 10 can collect and arrange wire segments at relatively high discharge rates, e.g., 20–30 segments per minute. Apparatus 10 performs optimally on "passive" types of wire.

Figure 6:
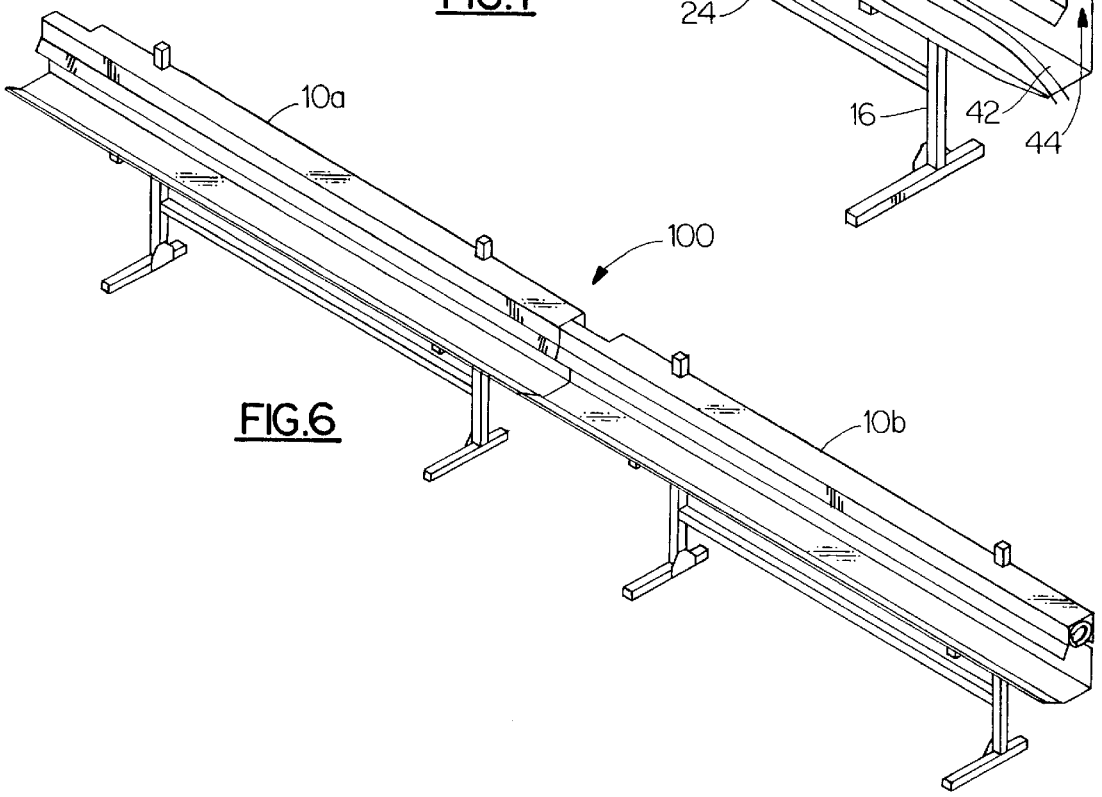
FIG. 6 is a perspective view of two wire collection apparatus of the present invention, disposed end-to-end.

Referring now to FIG. 6, a wire collection system 100 includes two wire collection apparatus 10*a* and 10*b*, as above described. The wire collection apparatus are disposed in an end-to-end arrangement, where the distal opened end of apparatus 10 is juxtaposed and aligned with the proximal opened end of apparatus 10*b*. The actuating devices of apparatus 10*a* and 10*b* are synchronized to open and close their respective wire channels simultaneously. This arrangement may be desirable to accommodate unusually long wire segment lengths. This arrangement is made possible, and is easy to configure, due to the unique and simple design of the present invention, as described above.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

What we claim is:

1. A wire collection apparatus for use with a wire cutting machine, comprising:

a tubular wire channel containing an axial opening extending along the length thereof and a transverse open extending along an arc thereof, said channel containing a proximal open end for receiving a portion of wire from the wire cutting machine and a distal open end for allowing the leading terminus of the wire portion to extend therethrough, if necessary;

a tubular channel closure positioned inside of and substantially concentric with said tubular wire channel, said closure containing an axial opening along the length thereof and containing open ends in alignment with the proximal and distal ends, respectively, of said wire channel, said closure being rotatable inside said channel between open and closed positions to open and close the axial opening of said channel, respectively, the axial openings of said closure and said channel being in alignment in the open position and out of alignment in the closed position; and an actuating device coupled to said closure through the transverse opening of said channel and configured to rotate said closure between the open and the closed positions, the transverse opening having a dimension along the arc of said channel which is sufficient to allow said actuating device to rotate said closure between the open and closed positions.

2. The wire collection apparatus of claim 1, wherein the transverse opening of said wire channel is located substantially at the midpoint between the proximal and the distal ends of said channel.

3. The wire collection apparatus of claim 1, wherein said actuating device includes a stem having one end mounted to said tubular closure such that said stem projects radially from said closure and through the transverse opening of said wire channel, and an air cylinder having a reciprocating piston arm pivotally coupled to said stem, whereby reciprocating motion of the piston arm is translated into rotational motion of said tubular closure.

4. The wire collection apparatus of claim 3, wherein said stem contains an elongated hole extending along the length of said stem, and wherein said actuating device further includes a clevis attached to the distal end of the piston arm, said stem being received in the clevis, a cylindrical bearing received in said clevis and slidably engaging the elongated hole in said stem, and a clevis pin extending through the clevis, the bearing, and the elongated hole, such that a pivotal and slidable coupling is effected between the piston arm and said stem.

5. The wire collection apparatus of claim 4, wherein the clevis pin is held in place by a washer and a cotter pin on each side of the clevis pin.

6. A wire collection apparatus for use with a wire cutting machine, comprising:

a tabular wire channel containing an axial opening along the entire length of said channel, said channel containing a proximal open end for receiving a portion of wire from the wire cutting machine and a distal end, said channel further containing an opening extending transversely along an arc of said channel and located substantially at the midpoint between the proximal and distal ends of said channel;

a tubular channel closure positioned inside of and substantially concentric with said tubular wire channel, said closure containing an axial opening along the entire length of said closure and further containing a proximal open end and a distal end in alignment with the proximal and distal ends, respectively, of said wire channel, said closure being rotatable inside said channel between open and closed positions to open and close the axial opening of said channel, respectively, the axial openings of said closure and said channel being in alignment in the open position and out of alignment in the closed position, and an actuating device mounted to said closure through the transverse opening of said channel and configured to rotate said closure between the open and the closed positions, the transverse opening having a dimension along the arc of said channel which is sufficient to allow said actuating device to rotate said closure between the open and closed positions.

7. The wire collection apparatus of claim 6, wherein the distal end of said wire channel is open.

8. The wire collection apparatus of claim 6, wherein the distal end of said channel closure is open.

* * * * *